US007854028B1

(12) United States Patent
Williams

(10) Patent No.: US 7,854,028 B1
(45) Date of Patent: Dec. 21, 2010

(54) DISPOSABLE TOILET SEAT COVER APPARATUS

(76) Inventor: Barbara A. Williams, 3021 Avenue T, Riviera Beach, FL (US) 33404

( * ) Notice: Subject to any disclaimer, the term of this patent is extended or adjusted under 35 U.S.C. 154(b) by 475 days.

(21) Appl. No.: 11/952,312

(22) Filed: Dec. 7, 2007

(51) Int. Cl.
*A47K 13/14* (2006.01)

(52) U.S. Cl. ..... 4/245.6; 4/239; 4/580; 137/223; 441/92; 441/94; 441/96; 222/510

(58) Field of Classification Search ..... 4/239, 4/580–583; 222/3, 510; 441/92, 94, 96
See application file for complete search history.

(56) References Cited

U.S. PATENT DOCUMENTS

| | | | | |
|---|---|---|---|---|
| 2,660,334 | A * | 11/1953 | Burke | 222/3 |
| 3,808,612 | A | 5/1974 | Boyle et al. | |
| 4,649,575 | A | 3/1987 | Blair et al. | |
| 4,972,971 | A * | 11/1990 | Janko et al. | 222/5 |
| 5,107,549 | A | 4/1992 | Pitts et al. | |
| 5,172,431 | A | 12/1992 | Rohde | |
| D337,228 | S | 7/1993 | Giugiaro | |
| 5,551,096 | A | 9/1996 | Gardner | |
| 5,557,809 | A | 9/1996 | Adams | |
| 5,619,757 | A * | 4/1997 | Baratta | 4/239 |
| 7,029,354 | B1 * | 4/2006 | Griffin | 441/92 |
| D530,804 | S | 10/2006 | Forbes et al. | |
| 2004/0144383 | A1 * | 7/2004 | Thomas et al. | 128/204.18 |
| 2004/0161580 | A1 | 8/2004 | Schiller | |

* cited by examiner

*Primary Examiner*—Gregory L Huson
*Assistant Examiner*—Lauren Heitzer
(74) *Attorney, Agent, or Firm*—Crossley Patent Law; Mark A. Crossley

(57) ABSTRACT

A disposable toilet seat cover apparatus is for use on the existing seat of a toilet. The apparatus is provided in a textured biodegradable water soluble material and resists slippage on the seat. A pull tab provides for the gas chamber within the valve assembly of the initially compactly folded apparatus to release a compressed gas to fill the seat cover/cushion. After use, the apparatus' biodegradable makeup provides for either discarding in a trash bin or for deposit into the bowl water, where the apparatus quickly deflates and dissolves. Any of the apparatus not immediately dissolved in the bowl water is easily flushed.

5 Claims, 3 Drawing Sheets

DISPOSABLE TOILET SEAT COVER APPARATUS

BACKGROUND OF THE INVENTION

Disposable toilet seat covers are often employed for sanitation purposes. The art is crowded with variations and improvements upon variations. Those seat covers made of paper are well known for their problems in displacement from a seat. Awkwardness in application and removal are also common with such seat covers, which contributes to an overall distrust in use by the populace. Due to these and other problems, still more innovations have evolved. Some offered are pulled from a roll to be supplied in the toilet area. The expenses and related problems of ready-supplied seat covers in the toilet areas are known to those who must supply them. For these reasons, personally carried seat covers are a viable consideration to those wishing to guard themselves against potential bacteria and viruses. Cushioning is another element often desired. And water solubility and biodegradability are also preferred features.

If a cushioning seat cover is to be supplied, compactness is a very real consideration, as anything of bulk does not offer truly personal portability. For this reason, inflatability is key. However, of the inflatable devices proffered each requires oral inflation, which is not desirable to most users considering the environment they are used in. Even if the device is sanitary, the personal resistance to use is high, as is the inconvenience and the time factor involved. No device is currently offered which is personally portable, capable of being carried in quantity, biodegradable, resistant to displacement without adhesive, available for use without manual unfolding or tearing from a sheet or roll, and is self-inflated. The present disposable toilet seat cover apparatus fulfills these needs.

FIELD OF THE INVENTION

The apparatus relates to disposable toilet seat covers and more especially to a biodegradable self-inflated disposable toilet seat cover that is personally carried in singularity or in quantity.

SUMMARY OF THE INVENTION

The general purpose of the disposable toilet seat cover apparatus, described subsequently in greater detail, is to provide a disposable toilet seat cover apparatus which has many novel features that result in an improved disposable toilet seat cover apparatus which is not anticipated, rendered obvious, suggested, or even implied by prior art, either alone or in combination thereof.

To attain this, the disposable toilet seat cover apparatus is provided in more than one embodiment. One embodiment comprises an oval cushion. Another embodiment comprises an oval front cushion with a flat edged rear cushion seamlessly joined. The cushion and cushions are comprised of a non-slick material finish to resist slippage on a toilet seat. The apparatus can be individually supplied and is also supplied in packets with a plurality of pull out apparatuses within the packet. The thin biodegradable material makeup provides for compactly folding the apparatus in packaging. As each apparatus is individual, no tear lines or the like are used to join one to another. When a user wishes one apparatus, it is pulled from the packet, if so packaged, and the pull tab is used to inflate the apparatus from a folded state into a ready-to-use state. The inflated cushion, or cushions, respectively, provide between ⅜ and ½ inches of height. The apparatus therefore not only insures sanitary protection, but also the desirable cushioning between user and toilet seat. The gas chamber, too, is biodegradable. Due to the relatively thin inflated state, the gas chamber need not carry a high volume or pressure.

As the gas chamber makeup is thicker than other parts of the apparatus, it holds the needed pressure. Also, since the gas chamber is relatively small, there is no resistance to flushing the chamber, thereby allowing for slower dissolution of the chamber into the water, relative to the cushion.

Thus has been broadly outlined the more important features of the improved disposable toilet seat cover apparatus so that the detailed description thereof that follows may be better understood and in order that the present contribution to the art may be better appreciated.

An object of the disposable toilet seat cover apparatus is to protect a user from contamination from a toilet seat.

Another object of the disposable toilet seat cover is to self-inflate.

A further object of the disposable toilet seat cover apparatus is to be disposable.

An added object of the disposable toilet seat cover apparatus is to be biodegradable.

And, an object of the disposable toilet seat cover apparatus is to be compact such that personal transport of a plurality of apparatuses is possible.

Still another object of the disposable toilet seat cover apparatus is to be slip resistant when in use.

These together with additional objects, features and advantages of the improved disposable toilet seat cover apparatus will be readily apparent to those of ordinary skill in the art upon reading the following detailed description of presently preferred, but nonetheless illustrative, embodiments of the improved disposable toilet seat cover apparatus when taken in conjunction with the accompanying drawings.

In this respect, before explaining the current embodiments of the improved disposable toilet seat cover apparatus in detail, it is to be understood that the disposable toilet seat cover apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved disposable toilet seat cover apparatus. It is therefore important that the claims be regarded as including such equivalent constructions insofar as they do not depart from the spirit and scope of the disposable toilet seat cover apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the disposable toilet seat cover apparatus generally designated by the reference number 10 will be described.

Figure 1:
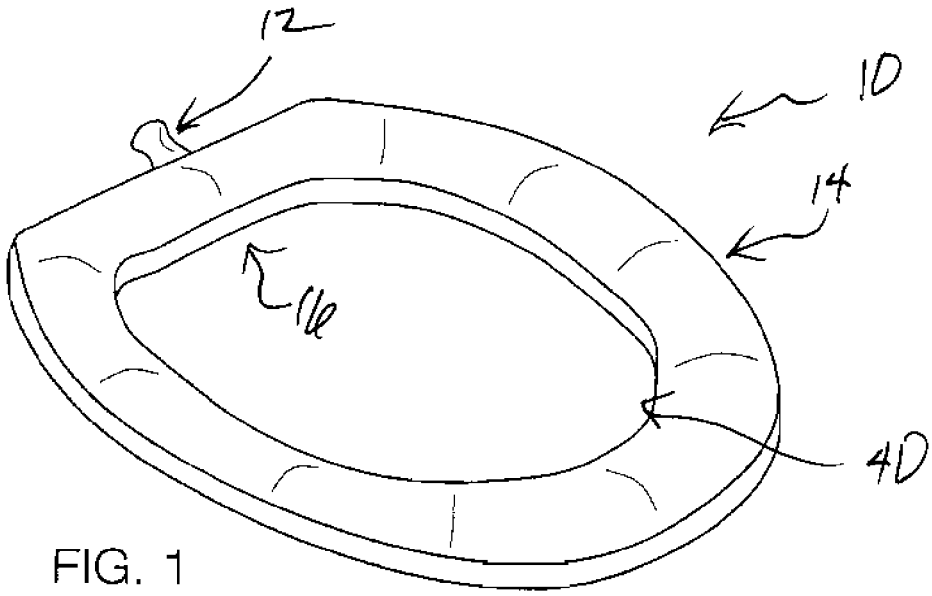
FIG. 1 is a frontal perspective view of the apparatus in preparation for use.
Figure 2:
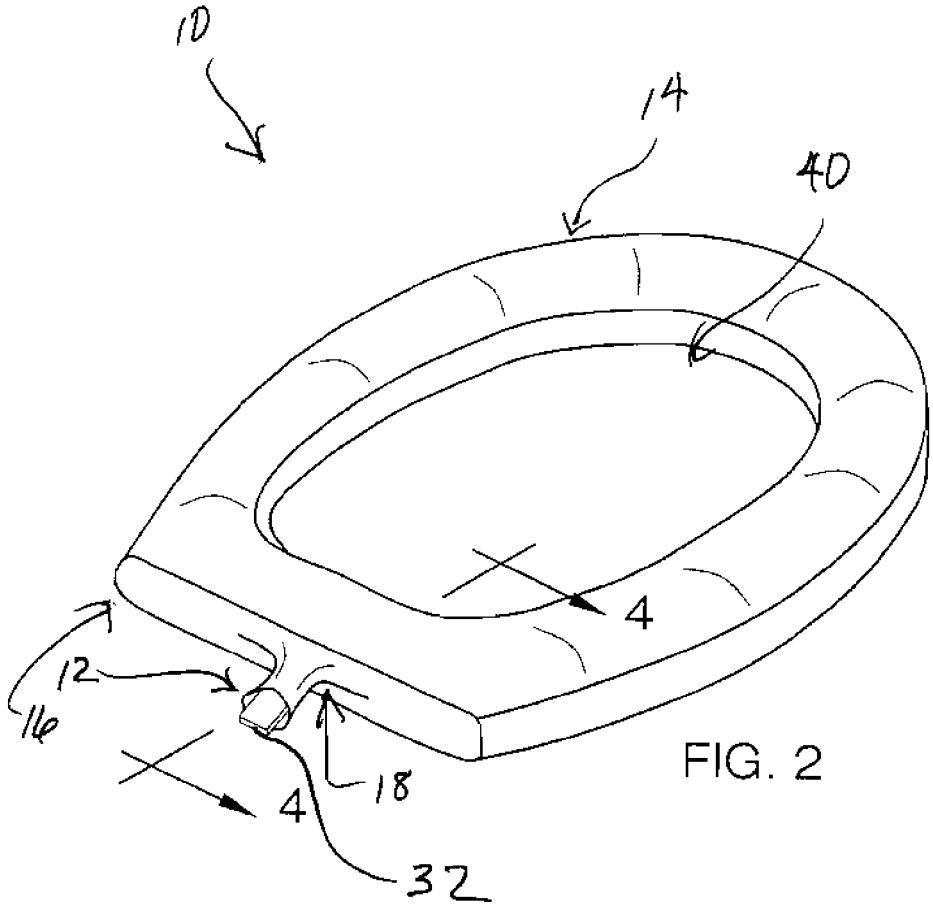
FIG. 2 is a rear perspective view of the apparatus in preparation for use.
Figure 3:
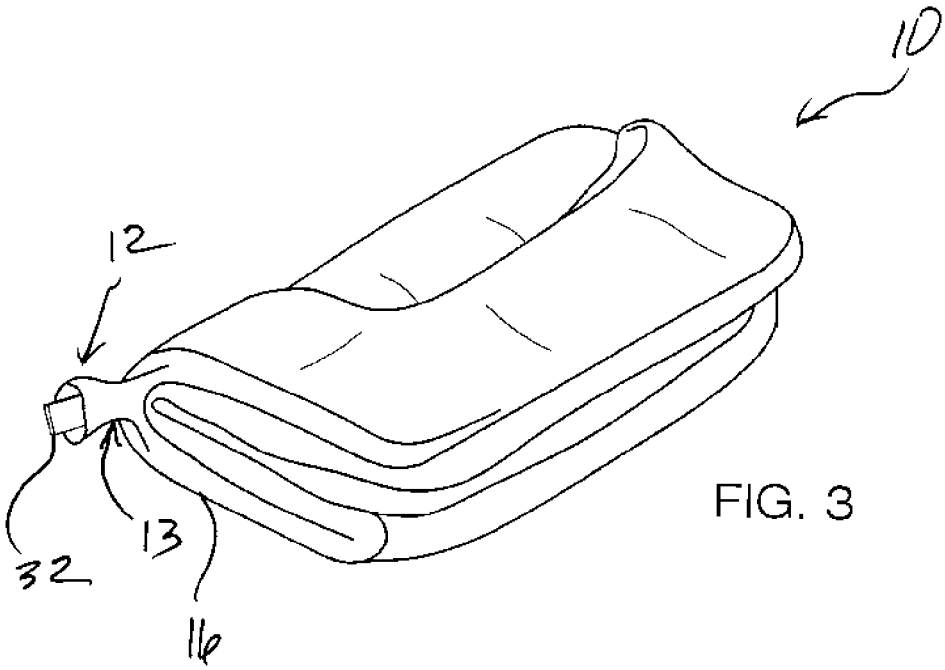
FIG. 3 is a perspective view of the apparatus in its folded state.
Figure 4:
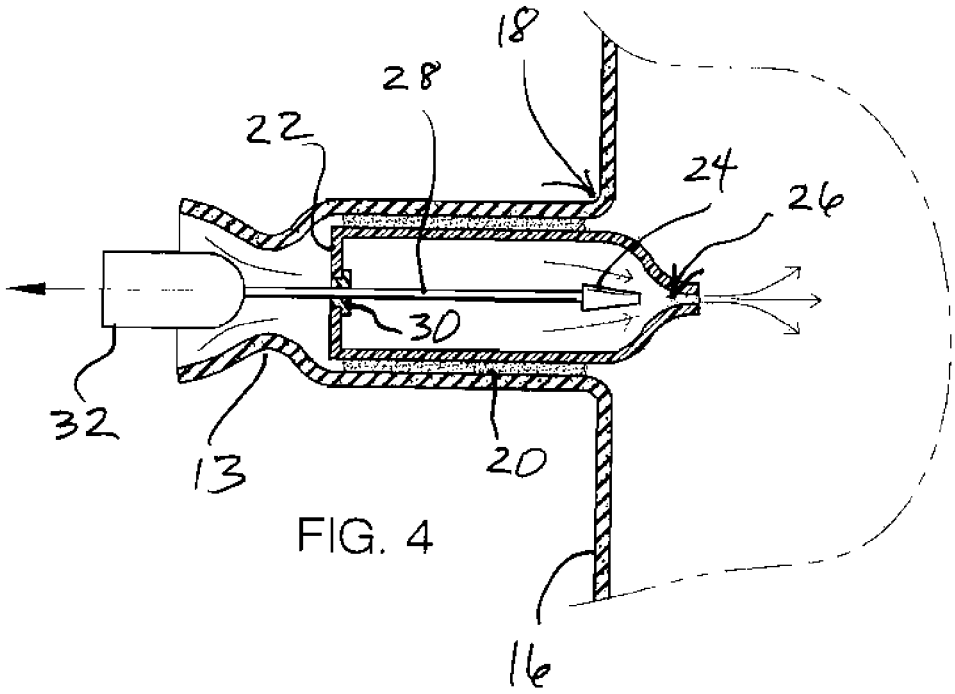
FIG. 4 is a cross sectional view of the valve assembly.
Figure 5:
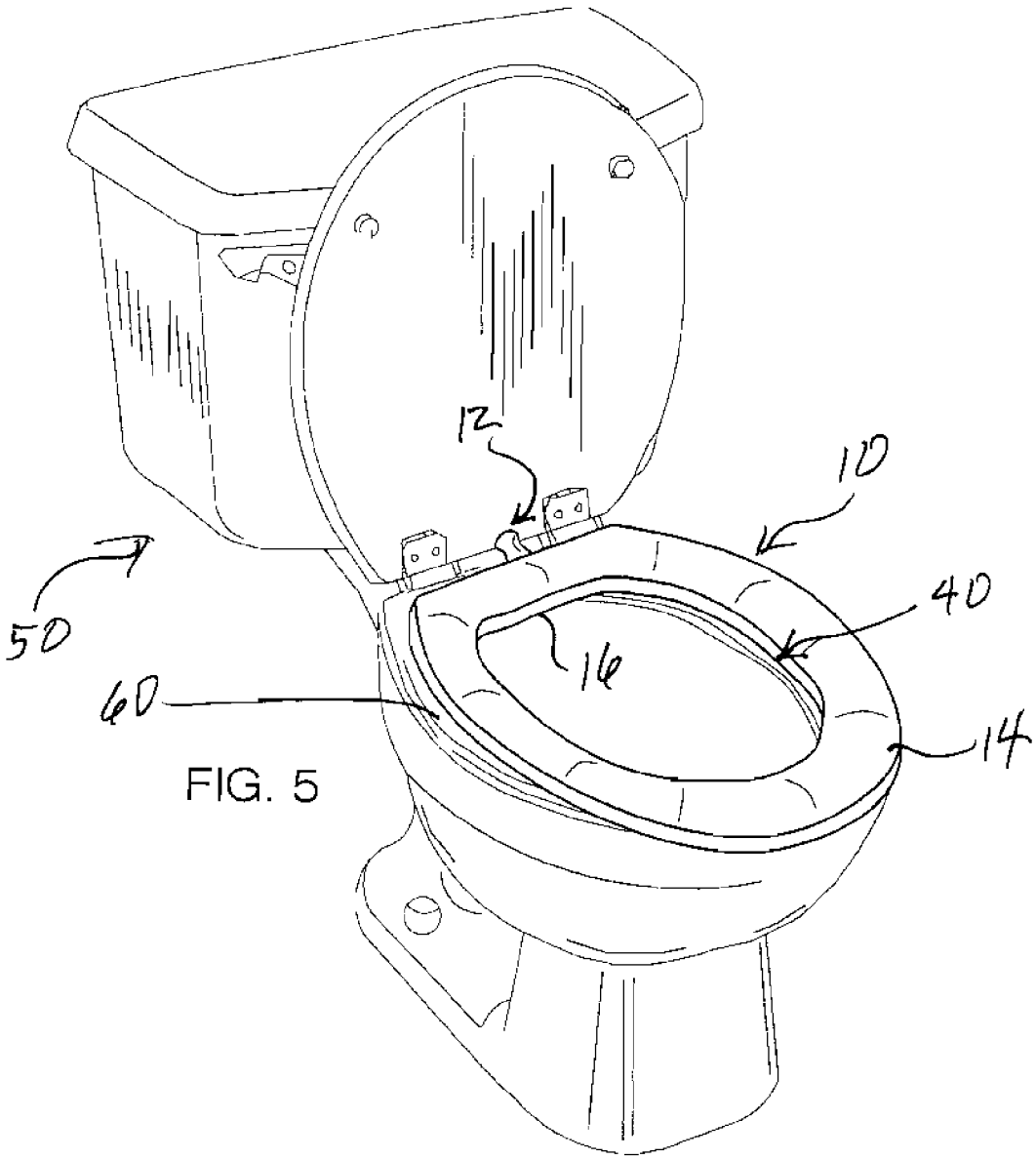
FIG. 5 is a perspective view of the apparatus in use on an existing toilet.

Referring to FIG. 5, the disposable single use toilet seat cover apparatus 10 is for use on the existing seat 60 of a toilet 50. The apparatus 10 is provided in a textured biodegradable material to resist slippage on the seat 60. The apparatus 10 is simply placed on the seat 60 as needed. After use, the apparatus 10 biodegradable makeup provides for either discarding in a trash bin or for deposit into the bowl water, where the apparatus 10 quickly deflates and dissolves. Any of the apparatus 10 not immediately dissolved in the bowl water is easily flushed.

Referring to FIGS. 1-4, the apparatus partially comprises the oval front cushion 14 seamlessly joined to the flat edged rear cushion 16. The combined cushions 14 and 16 have an opening 40 in the center mirroring that of a toilet seat 60. The combined cushions 14 and 16 are capable of compact folding in an uninflated state. The valve assembly 12 is disposed at the rear of the rear cushion 16. The valve assembly 12 provides selective inflation of the inflatable cover apparatus 10. Further the valve assembly 12 is joined to the rear cushion 16 by a tapered junction 18 surrounding the joining. The tapered junction 18 prevents kinking of the joining which might otherwise occur with a straight seam or the like. The valve assembly 12 further comprises a constriction 13 proximal to an exterior opening of the assembly 12. The constriction 13 aids the adhesive 20 to insure that the gas chamber 22 is positively and securely disposed. The valve assembly 12 further comprises a biodegradable cylindrical gas chamber 22, containing a compressed gas, adhesively 20 bonded within the valve assembly 12. The gas chamber 22 has a flat rear, a body, and a chamber neck 26 at the front. The flat rear of the chamber 22 is aided in confinement by the valve assembly constriction 13. A rear seal 30 is disposed within the flat rear of the chamber 22. The shaft 28 is disposed within the chamber 22 and slideably exits the rear seal 30. The pull tab 32 is disposed on the exterior end of the shaft 28. The conical seal 24 is disposed on the interior end of the shaft 28, whereby the conical seal 24 seals against the chamber neck 26 of the gas chamber 22, the gas within aiding in holding the conical seal 24 in sealed position. Pulling of the pull tab 32 releases a compressed gas from within the gas chamber 22, thereby filling the apparatus 10.

With respect to the above description then, it is to be realized that the optimum dimensional relationships for the parts of the disposable toilet seat cover apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the disposable toilet seat cover apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the disposable toilet seat cover apparatus may be used.

Therefore, the foregoing is considered as illustrative only of the principles of the disposable toilet seat cover apparatus. Further, since numerous modifications and changes will readily occur to those skilled in the art, it is not desired to limit the disposable toilet seat cover apparatus to the exact construction and operation shown and described, and accordingly, all suitable modifications and equivalents may be resorted to, falling within the scope of the disposable toilet seat cover apparatus.

What is claimed is:

1. A disposable single use toilet seat cover apparatus, the apparatus comprising:

an inflatable cover comprising an oval shaped cushion, the cushion having an opening in a center mirroring that of a toilet seat, the cushion capable of folding in an uninflated state;

a valve assembly disposed at a rear of the cushion, the valve assembly providing selective inflation of the inflatable cover, the valve assembly having a constriction proximal to an exterior opening, the valve assembly further comprising:

a biodegradable cylindrical gas chamber adhesively bonded within the valve assembly, the gas chamber having a flat rear, a body, and a chamber neck at a front, the flat rear of the chamber further confined by the valve assembly constriction;

a rear seal within the flat rear of the chamber;

a shaft within the chamber and exiting the rear seal;

a conical seal on an interior end of the shaft, whereby the conical seal seals against the chamber neck of the gas chamber;

means for releasing a gas from within the gas chamber, thereby filling the cushions.

2. The apparatus according to claim 1 wherein the joining of the valve assembly to the cushion further comprises a tapered junction.

3. The apparatus according to claim 1 wherein the means for releasing a gas from within the gas chamber further comprises a pull tab.

4. The apparatus according to claim 2 wherein the means for releasing a gas from within the gas chamber further comprises a pull tab.

5. A disposable single use toilet seat cover apparatus, the apparatus comprising:

an inflatable cover comprising an oval shaped front cushion seamlessly joined to a flat-edged rear cushion, the cushions having an opening in a center mirroring that of a toilet seat, the combined cushions capable of folding in an uninflated state;

a valve assembly disposed at a rear of the rear cushion, the valve assembly providing selective inflation of the inflatable cover, the valve assembly joined to the rear cushion by a tapered junction, the valve assembly having a constriction proximal to an exterior opening, the valve assembly further comprising:

a biodegradable cylindrical gas chamber adhesively bonded within the valve assembly, the gas chamber having a flat rear, a body, and a chamber neck at a front, the flat rear of the chamber further confined by the valve assembly constriction;

a rear seal within the flat rear of the chamber;

a shaft within the chamber and exiting the rear seal;

a pull tab on an exterior end of the shaft;

a conical seal on an interior end of the shaft, whereby the conical seal seals against the chamber neck of the gas chamber;

whereby pulling of the pull tab releases a gas from within the gas chamber, thereby filling the cushions.

* * * * *